United States Patent [19]

Steinbach

[11] Patent Number: 4,712,400

[45] Date of Patent: Dec. 15, 1987

[54] REMOVABLE CYLINDER LOCK

[75] Inventor: Robert Steinbach, Glendale Heights, Ill.

[73] Assignee: Chicago Lock Company, Chicago, Ill.

[21] Appl. No.: 37,736

[22] Filed: Apr. 13, 1987

Related U.S. Application Data

[63] Continuation-in-part of Ser. No. 491,374, May 4, 1983.

[51] Int. Cl.[4] ..... E05B 29/04

[52] U.S. Cl. ..... 70/369; 70/373; 70/421

[58] Field of Search ..... 70/DIG. 44, 392, 367–378, 70/421, 364 R

[56] References Cited

U.S. PATENT DOCUMENTS

| | | | |
|---|---|---|---|
| 799,666 | 9/1905 | Oleschak | 70/376 |
| 1,114,186 | 10/1914 | Ross | 70/376 |
| 1,805,891 | 5/1931 | Shinn | 70/369 |
| 1,979,938 | 11/1934 | Jacobi | 70/369 |
| 1,990,934 | 2/1935 | Falk | 70/369 |
| 2,061,456 | 11/1936 | Falk | 70/368 |
| 2,065,683 | 12/1936 | Gahagan | 70/369 |
| 3,518,855 | 7/1970 | Wake | 70/421 |
| 3,751,952 | 8/1973 | Rubner | 70/368 |
| 4,398,405 | 8/1983 | Patriquin | 70/369 |
| 4,416,129 | 11/1983 | Thimot | 70/369 |

*Primary Examiner*—Lloyd A. Gall

*Attorney, Agent, or Firm*—Basil E. Demeur; Robert E. Knechtel; Alan B. Samlan

[57] ABSTRACT

There is disclosed an improved rotatable cylinder lock of the type formed by a cylindrical housing and a removable elongated lock core, the cylinder housing including a tumbler block positioned within the cylindrical housing and extending inwardly with respect to the cylindrical housing, and a tumbler ledge having an interior peripheral surface mounted within the cylinder housing adjacent the tumbler block and extending circumferentially for a portion of the periphery of the cylinder housing, the lock core including a plurality of lock tumblers and a release tumbler which is positionally carried by the lock core to ride on a shoulder formed by the tumbler ledge throughout the rotational movement of the lock core, except in the unlocked position when the release tumbler is positioned such that it is free of blockage by the tumbler block thereby to permit removal of the lock core from the cylindrical housing, the lock core further including a block restrictor relief section formed therein which accommodates the rotational movement of the tumbler block therein and also accommodates the release of the release tumbler to permit removal of the lock core from the housing. A further improvement of the cylinder lock permits the lock tumblers and the release tumbler to be configured identically thereby eliminating the need for any specially configured release tumbler.

6 Claims, 6 Drawing Figures

FIG. 1
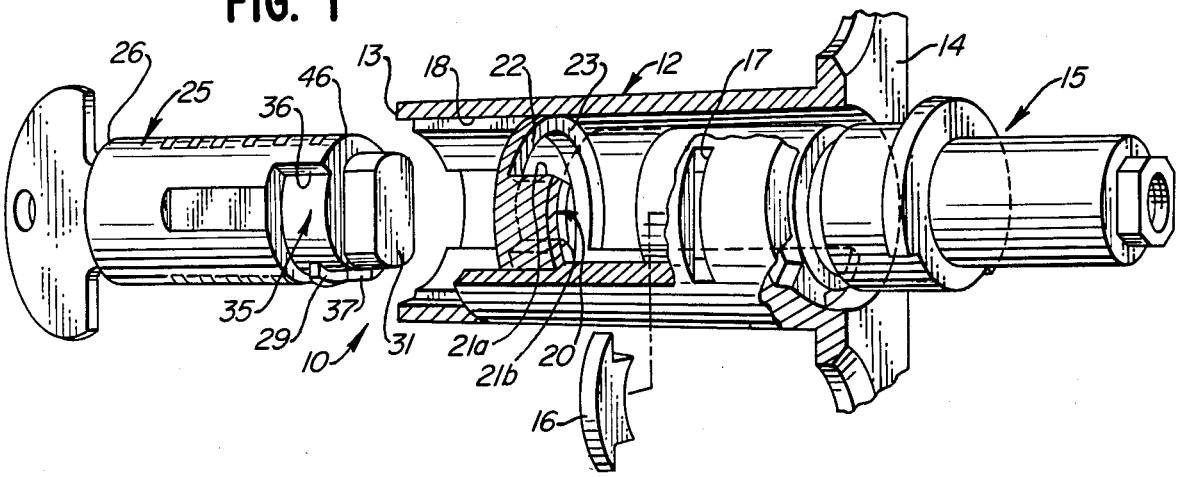
FIG. 2
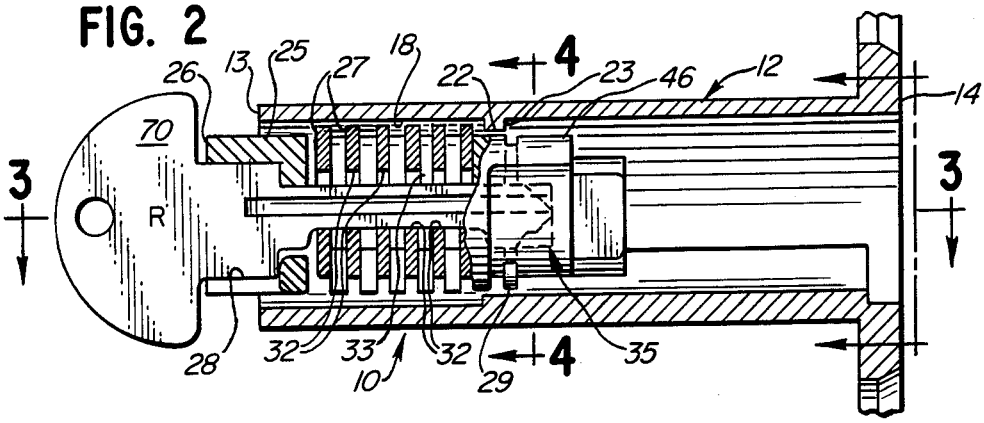
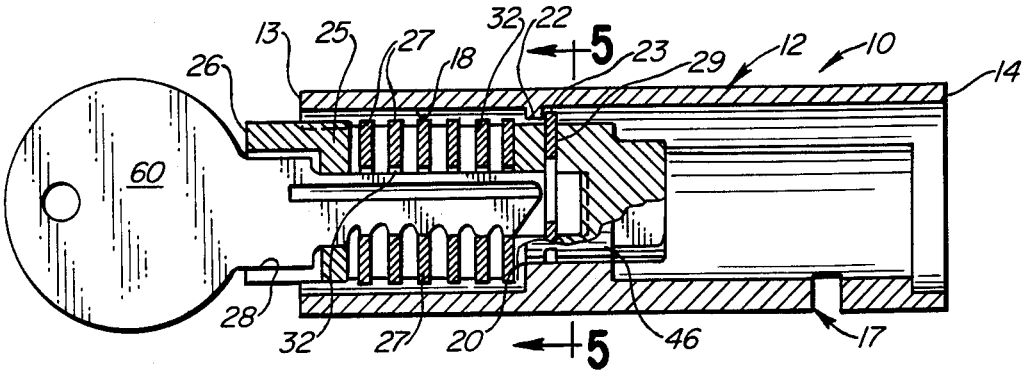
FIG. 3

FIG. 4
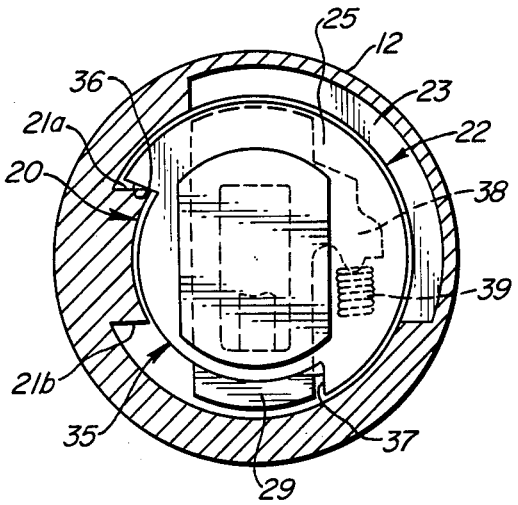
FIG. 5
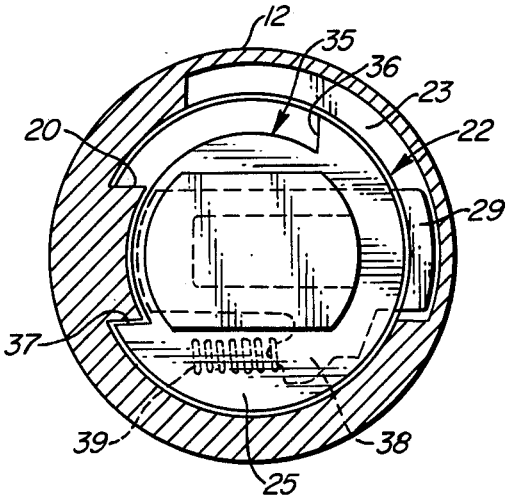
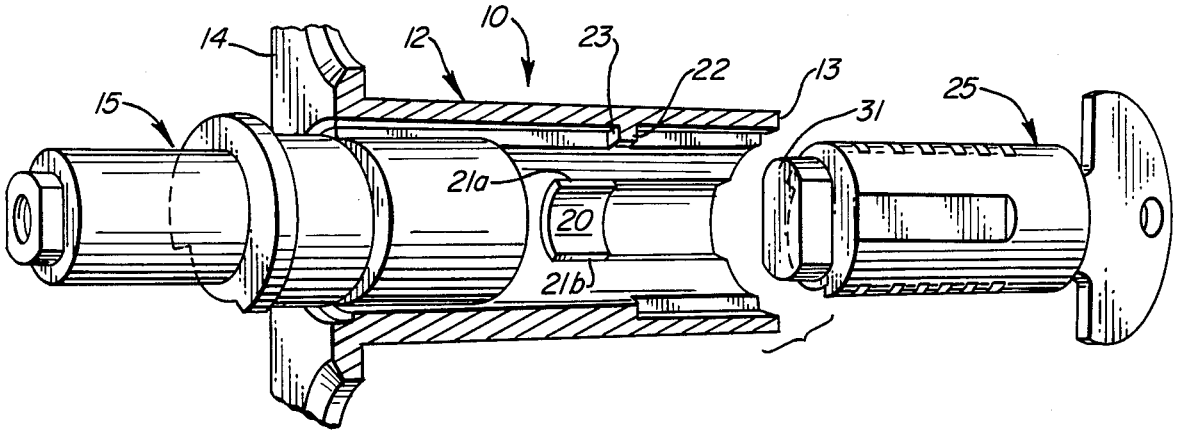
FIG. 6

REMOVABLE CYLINDER LOCK

CROSS-REFERENCE TO CO-PENDING APPLICATION

This application is a continuation-in-part of application filed on May 4, 1983 under Ser. No. 491,374 in the name of Robert Steinbach, presently pending.

BACKGROUND OF THE INVENTION

The use of cylinder locks in connection with various pieces of equipment, such as furniture, automobiles and the like is well known. Various forms of such cylinder locks have been constructed for diverse applications, the configuration of any particular cylinder lock employed being a function of the equipment or other environment in which the lock is utilized.

It is further known that in some applications, the equipment in which the lock is installed is necessarily constructed with the locking mechanisms contained interiorally within the equipment. Hence, once the equipment is fully constructed, having the entire lock mechanism self-contained therein, it quite often develops that the keyed cylinder portion of the lock is similarly contained within the equipment exposing only the key slot. Hence, should any difficulties arise in connection with the operation of the portion of the lock operated by a bitted key, it is often necessary to dismantle the equipment in order to gain access to repair the lock. Even more importantly, should the consumer or user of the equipment wish to re-key the cylinder portion of the lock such that the lock will be operated by a different key, it is similarly necessary to dismantle the equipment in order to gain access to the cylinder portion of the lock. This in true, for example, in connection with commercial desks and other office equipment, which include drawers having a lock mechanism associated therewith, which permits the user thereof to actuate the lock mechanism in order to lock all of the drawers in a closed position. In the past, desks or other office equipment incorporating such lock mechanisms have been constructed with the locking levers which effect the locking function being totally enclosed within the confines of the equipment, the only portion of the lock mechanism accessible to the user being the keyed portion which presents the keyed slot to the user. In this, as well as other applications, it became apparent that it would be necessary to have a cylinder lock wherein the lock core portion of the lock could be removed from the cylinder housing in order to permit the lock core to be replaced, re-keyed, or to repair any damage. To this end, various constructions of removable lock cores have been developed with a view toward permitting the independent removal of the lock core portion of the lock from the cylinder housing.

Typically, cylinder locks having a removable lock core have been developed wherein the lock core is usually removable by means of a special release key which is intended to operate a special release tumbler once the lock is manipulated into a certain position by the locking key. The release key will not operate the lock and can only be used in the release position to remove the lock core. Hence, the release key functions only for the purpose of lock core removal, and does not operate the lock in any respect. In addition, in order to accommodate this type of construction, the cylinder housing is usually grooved in a special manner which will permit the lock core to be rotated and yet, retained within the housing in any rotational position with the exception of one rotational position wherein the special release tumbler can then be manipulated by the release key to ride into a particularly shaped grooved formed in the interior wall of the cylindrical housing. In this manner, lock core removal may be effected.

A cylinder lock exemplary of the construction mentioned above is shown in U.S. Pat. No. 2,061,456 which shows a cylinder lock having a removable lock core associated therewith. As is shown in the drawings, the cylindrical housing includes a pair of opposed grooves formed in the housing wall which are intended to coact with the release tumbler contained within the lock core. One of the grooves is shown to be wider than the other groove, and the release tumbler has an upper portion which corresponds only with the wider groove. The design is such that the lock core cannot be removed from the cylindrical housing unless and until the lock core is rotatably manipulated such that the release tumbler is in registry with the wider groove. In this position, when the release key is inserted, it will actuate the release tumbler into a retracted position into the wider groove permitting the lock core to be withdrawn.

Similarly, in U.S. Pat. No. 2,460,709, the cylindrical housing in which the removable lock core is contained is designed with a specially constructed groove to accommodate the sixth tumbler formed in the lock core. The sixth tumbler functions as the release tumbler and alternated between a locked position, and a release position. The lock core can only be removed when the sixth tumbler is aligned properly such that the release tumbler is actuated to the release position where it will ride in an appropriately shaped groove formed in the cylindrical housing and permit removal of the lock core.

The above-mentioned prior art patents, as well as various others not specifically mentioned, all have certain basic features in common. In particular, one such feature is that the release tumbler which controls the locking position and the release position of the lock core relative to the cylindrical housing is a specially constructed tumbler, usually having a wider disc portion associated therewith, the release tumbler coacts with an appropriately formed groove in the interior wall of the cylindrical housing. It will be appreciated, therefore, that in order to manufacture cylindrical locks of this type, it is necessary that the cylindrical housings be specially grooved during the manufacturing process to accommodate the release tumbler which controls the lock and release positions of the lock core. This requires a separate manufacturing step in order to properly groove the interior walls of the cylindrical housing, after which the interior portions of the cylindrical housing must be deburred. In addition, it will be appreciated that a specially constructed release tumbler must be utilized which is different than the lock tumblers normally contained along the length of the lock core. This adds a further manufacturing expense to the production costs involved in producing a cylindrical lock having a removable lock core.

Finally, it is noted that with all prior art locks having a removable lock core, the lock core itself is uniformly constructed along the length thereof. This construction is predicated upon the fact that the cylinder housings in such prior art locks generally have a ledge along which the release tumbler will ride during its locked position, and also are provided with the specially formed groove in the interior surface of the housing which accommodates the positioning of the release tumbler when actuated by the release key in order to permit lock core removal.

In accordance with the present invention, the cylindrical housing and lock core have been reconstructed and redesigned in a manner which permits positive steps for the rotational movement of the lock core when contained within the cylindrical housing, while eliminating the need for any special grooves to be formed within the interior confines of the cylindrical housing in order to accommodate a removable lock core.

OBJECTS AND ADVANTAGES

In accordance with the present invention, the principal object of the invention is to provide an improved cylindrical lock having a removable lock core whereby the construction of the lock core and the cylindrical housing is simplified, and further, that the requirement for coring a special groove in the cylindrical housing, and the further requirement for a special release tumbler is eliminated.

In accordance with the foregoing object, it is a further object of the present invention to provide an improved cylindrical lock having a removable lock core of the type described, wherein the cylindrical housing is provided with a tumbler block formed along the interior peripheral surface of the cylindrical housing and extending inwardly toward the interior confines of the cylindrical housing for a short distance, and the interior of the cylindrical housing further includes a tumbler ledge associated with the tumbler block, the tumbler block and tumbler ledge both extending inwardly from the interior sidewalls of the cylindrical housing for a short distance, and functioning to block the release tumbler which is contained within the lock core unless and until the lock core is rotated to a position such that the tumbler block is out of blocking engagement with the release tumbler in order to permit lock core removal.

In accordance with the foregoing object, it is a further object to provide an improved cylinder lock of the type described, wherein the release tumbler is constructed in the same configuration as the lock tumblers, thereby eliminating the need for any specially constructed release tumbler as taught by the prior art.

In connection with the foregoing objects, it is a further object to provide an improved cylindrical lock of the type described wherein the lock core is provided with a block restrictor relief section, the block restrictor relief section cooperating with and accommodating the tumbler block to ride therein during the normal rotational movement of the lock, and cooperating with each other to form stop positions for the rotational movement of the lock when rotated between a locked and an unlocked position.

In connection with the foregoing object, a further object of the present invention is to provide an improved cylindrical lock of the type described, wherein the block restrictor relief has a circumferential length greater than the circumferential length of the tumbler block, such that when the lock core is rotatably manipulated to the release position, and upon insertion of the release key, the release tumbler is caused to ride out of engagement with the tumbler ledge, and to extend into the block restrictor relief portion of the lock core, thereby permitting removal of the lock core relative to the cylindrical housing.

In connection with all of the foregoing objects, it is a further object of the present invention to provide an improved cylindrical lock of the type described wherein the cylinder housing may be formed as a die-cast part, eliminating the need for any special grooving and deburring in order to produce a cylindircal housing which will accommodate a removable lock core therein, and wherein the release tumbler and lock tumblers are all configured identically thereby eliminating any further additional costs associated with the requirement of having specially configured and constructed release tumblers.

Further features of the invention pertain to the particular arrangement of the elements and parts whereby the above, as well as other operating features are attained.

The invention, both as to its organization and method of operation, together with further objects and advantages thereof, will best be understood by reference to the following specification, taken in connection with the accompanying drawings.

BRIEF DESCRIPTION OF DRAWINGS

FIG. 1 is a side perspective view, in cross-section, and exploded, showing the construction of the cylindrical housing with the lock core removed therefrom, in accordance with the present invention;

FIG. 2 is a side elevational view, in cross-section, showing the release key inserted in the lock core, and actuating the release tumbler into a release position out of contact with the tumbler ledge, and extending into the block restrictor relief portion of the lock core in order to permit the removal of the lock core from the cylindrical housing;

FIG. 3 is a side elevational view, in cross-section, showing the insertion of the bitted key, in actuating position relative to the lock tumblers, but with the release tumbler in locking contact with the tumbler ledge thereby maintaining the lock core in its locked position within the cylindrical housing and with the cylindrical housing rotated 90° to show the tumbler block in blocking engagement relative to the release tumbler;

FIG. 4 is a cross-sectional view taken in the direction of the arrows along the line 4—4 of FIG. 2, showing the release tumbler as actuated by the release key, and extending into the lock restrictor relief portion of the lock core in order to permit removal of the lock core relative to the cylindrical housing;

FIG. 5 is a cross-sectional view taken in the direction of the arrows, along the line 5—5 of FIG. 3, showing the release tumbler in riding engagement relative to the tumbler ledge, thereby maintaining the lock core within the confines of the cylindrical housing; and FIG. 6 is a side perspective view, showing those portions of the lock core and cylindrical housing opposite to the view shown in FIG. 1, and showing the relationship of the tumbler ledge, tumbler block and block restrictor relief portions of the cylindrical housing and lock core respectively.

BRIEF SUMMARY OF INVENTION

In summary, the present invention is intended to provide a cylindrical lock of the type having a removable lock core, wherein the cylindrical housing is constructed with a tumbler block associated with a tumbler ledge formed on the interior surfaces of the cylindrical housing and extending inwardly therefrom for a short distance, a tumbler block extending inwardly for a slightly greater distance than the tumbler ledge, and the tumbler block and tumbler ledge coacting with a release tumbler located in the lock core such that the release tumbler will ride along and against a shoulder formed by the tumbler ledge and will be prevented from being actuated into its release position by the tumbler block, unless and until the lock is manipulated to a certain position such that the release tumbler may be actuated by a release key and positioned out of blocking engagement with the tumbler block. Further, the lock core is constructed to include a block restrictor relief portion which coacts and accommodates the riding of the tumbler block therein during the normal rotational movement of the lock core, and has a circumferential length greater than the circumferential length of the tumbler block, such that when the lock core is manipulated to the release position, the release tumbler may be actuated by the release key to come out of engagement with the tumbler block, and to extend into the block restrictor relief area of the lock core in order to permit removal of the lock core from the cylindrical housing.

The provision of the tumbler block, which extends inwardly into the interior confines of the cylindrical housing, and the tumbler ledge which similarly extends into the interior confines of the cylindrical housing, with the tumbler block extending a slightly greater distance inwardly into the interior confines, permits the construction of the cylindrical housing as a diecast or molded piece since it eliminates the need for constructing any special grooves in the cylindrical housing with the attendant deburring problems, and the further problem of having to provide a special release tumbler in the lock core to coact with such special grooves. It will also be appreciated that construction of the lock core and cylindrical housing of the present invention permits the release tumbler and lock tumblers to be constructed identically thereby totally eliminating the need for a special tumbler.

DETAILED DESCRIPTION OF DRAWINGS

As shown in the drawings, the improved cylinder lock 10 of the present invention is illustrated. The cylinder lock 10 includes a cylindrical housing 12 which includes an outer end 13 and an inner end 14. The latch control assembly 15 is shown to be positioned at the inner end of the cylindrical housing 12, and, as is well known in the art, is adapted to carry a latch (not shown) at the extreme inner end thereof which accomplishes the locking and unlocking function. The latch control assembly 15 is held firmly in place at the inner end 14 of the cylindrical housing 12 by means of a latch pin 16 which is inserted through a latch pin slot 17 and sets in a groove (not shown) formed in the latch control assembly 15 in a manner which is all commonly known in the art. The latch control assembly 15 and the operation thereof is well known in the art and is not considered to form a portion of the present invention, other than said mechanism is an integral part of any cylindrical lock assembly, including the lock assembly of the present invention.

The cylindrical housing 12 is shown to further include elongated slots 18 formed in the interior surfaces of the walls thereof, which function basically for the purpose of providing lock recesses to accommodate movement of the lock tumblers as the cylinder lock 10 is manipulated. The cylindrical housing 12 is further shown to include a tumbler block 20 which is formed on the interior surface of the cylindrical wall, and which extends inwardly for a distance, as can best be seen in FIGS. 1, 4, 5 and 6. Adjacent to the tumbler block 20 is a tumbler ledge 22, which is similarly formed on the interior surface of the cylindrical housing wall 12, and which extends inwardly for a short distance thereby to provide a shoulder 23 against which the release tumbler 29 will ride, as will be more particularly described hereinbelow.

The cylinder lock 10 is shown to further be provided with a lock core 25 which has an overall cylindrical configuration having an outer end 26 and an inner end 46, and is intended to be removably engagable with the cylindrical housing 12. In FIGS. 2 and 3 of the drawings, the lock core 25 is provided with a plurality of lock tumblers 27, and a release tumbler 29. The lock tumblers 27 and the release tumbler 29 are arranged in horizontal alignment along the length of the lock core 25 as is well known to those skilled in the art. The interior end of the lock core 25 is shown to include a latch control lug 31 which is intended to be received within the latch control assembly 15 for the purpose of manipulating the latch (not shown) into a locked and unlocked position respectively, as is, again, well known in the art. The outer end 26 of the lock core 25 is provided with a key slot 28 which accommodates the insertion of an appropriate key therein.

As is well known in the art, the lock core 25 is provided with a key way passage 33, while the lock tumbler 27 and release tumbler 29 are provided with a similar key way passage 32, in order to accommodate the bitted key therein such that the lock tumblers 27 may be manipulated according to a particular bitted configuration to position the tumblers in a locked or unlocked configuration as desired.

The lock core 25 is shown to be further provided with a block restricter relief portion 35 which, as shown in FIGS. 1, 3, 4, and 5 of the drawings, cooperates with the tumbler block 20 relative to the operation of the lock core 25 vis-a-vis the cylindrical housing 12 of the present invention. The block restrictor relief section 35 is formed along a portion of the circumferential length of the lock core 25, and in construction, assumes a greater circumferential length, than the circumferential length of the tumbler block 20. Furthermore, as will be appreciated from a view of FIGS. 4 and 5 of the drawings, the tumbler block 20 is designed and adapted to ride within the block restrictor relief section 35 formed in the lock core 25. Furthermore, it will be observed that the block restrictor relief section 35 is formed along the inner end of the lock core 25, such that the release tumbler 29 when in the locked position, will ride on the shoulder 23 formed by the tumbler ledge 22. The operational and dimensional relationship between the tumbler block 20 and the block restrictor relief 35 is shown in FIGS. 4 and 5 of the drawings. It is clearly shown that the circumferential length of the tumbler block 20 is shorter than the circumferential length of the block restrictor relief 35, and further, that the block restrictor relief 35 when in operational contact with the tumbler block 20 forms a stop for the rotational movement of the lock core 25. In this connection, the tumbler block 20 includes stop shoulders **21*a* and 21*b* respectively, which coact with stop flanges 36 and 37 respectively formed at either end of the block restrictor relief section 35. The respective stop positions are shown in FIGS. 4 and 5** of the drawings.

As illustrated in FIGS. 2 and 3 of the drawings, the cylinder lock 10 of the present invention is further adapted to operate with a lock key 60 and a release key 70. The lock key 60 (FIG. 3) has a shorter length than the release key 70, such that the lock key 60 will not operate the release tumbler 29. The release key 70 has a sufficient length and is properly fitted such that it will actuate the release tumbler 29 to release the release tumbler from engagement with the tumbler ledge 22 in order to permit removal of the lock core 25 from the cylindrical housing 12 as more fully explained hereinbelow.

The cylinder lock 10 of the present invention is of the type which is generally intended to permit the rotation of the lock core 25 throughout an arc of 90°. As is apparent from FIGS. 4 and 5 of the drawings, the rotational movement of the lock core 25 is stopped by means of the tumbler block 20 riding in the block restrictor relief 35 permitting only a 90° arc of travel. The step shoulders 21*a* and 21*b* coact with the stop flanges 36 and 37 to provide stop positions 90° apart. As is well known in the art, in view of the fact that the lock core 25 is connected to the latch control assembly 15 via the latch control lug 31, the rotational movement of the lock core 25 by the lock key 60 will cause a concomitant movement of the latch (not shown) into latching and unlatching relationship with respect to the equipment in which the lock is installed. As illustrated in FIG. 3 of the drawings, the lock key 60, given its shorter length, will only operate and actuate the lock tumblers 27 when inserted into the lock core 25. In this position, and as shown therein, the release tumbler 29 is in riding engagement with respect to the shoulder 23 formed by the tumbler ledge 22. It is therefore apparent that the lock core 25 cannot be removed from the cylindrical housing 12 in that position. This is again demonstrated in FIG. 5 of the drawings wherein the release tumbler 29 is shown to be riding on the shoulder 23 of the tumbler ledge 22.

As shown in FIGS. 2 and 4 of the drawings, however, when the release key 70 (having a longer length than the lock key 60) is inserted into the lock core 25, the same will actuate the release tumbler 29 causing the release tumbler 29 to ride out of engagement with the shoulder 23 formed by the tumbler ledge 22, and to extend downwardly into the block restrictor relief section 35 formed in the lock core 25. This is particularly shown in FIG. 4 of the drawings. In this position, the lock core 25 may now be removed from the cylindrical housing 12.

It will also be appreciated that in order for the release key 70 to operate the release tumbler 29, the lock core 25 must have been manipulated to the proper position such that the release tumbler 29 is out of blocking relationship with respect to the tumbler block 20. As shown in FIG. 5 of the drawings, should the release key 70 be inserted into the lock core 25 in the position illustrated therein, the release tumbler 29 could not ride out of engagement with the shoulder 23 because it is in blocking relationship with respect to the tumbler block 20. This is considered to be the normal locked position of the cylindrical lock 10.

However, if the lock key 60 were then inserted into the lock core 25, and the lock core 25 rotated through an arc of 90°, the position as shown in FIG. 4 of the drawings would be achieved, which is the unlocked position of the lock 10. In this position, the release tumbler 29 is out of possible engagement with the tumbler block 20, and therefore, upon insertion of the release key 70 into the lock core 25, the release tumbler 29 may be actuated to ride out of engagement with the shoulder 23, and into the block restrictor relief section 35 of the lock core 25. In this position, clearly the lock core 25 may be removed from the cylindrical housing 12.

It will also be appreciated from a view of FIGS. 2 through 5 of the drawings, that the release tumbler 29 and the lock tumblers 27 are configured and constructed as identical mates one to the other. It is contemplated in the present invention that the need or necessity for a specially constructed release tumbler is obviated in view of the fact that the cylindrical housing does not require any specially constructed grooves which would coact with a specially constructed release tumbler. In other words, by having eliminated the need for grooving the interior surfaces of the cylindrical housing by means of providing a tumbler block 20 and a tumbler ledge 22 pursuant to the present invention, the requirement for a specially constructed release tumbler has been obviated. It will also be appreciated that the necessity of specially grooving the interior surfaces of the cylindrical housing have similarly been eliminated. Once again, there being no requirement for a specially constructed release tumbler to ride in a specially grooved slot or groove within the cylindrical housing, eliminates the need for any special manufacturing procedure requring the grooving of the interior confines of the cylindrical housing, with the attendant deburring procedure which would be necessary thereafter.

It will also be appreciated from FIGS. 4 and 5 of the drawings, that the tumbler block 20 extends inwardly into the cylindrical housing 12 for a distance greater than the tumbler ledge 22. Indeed, as will be observed in FIGS. 4 and 5 of the drawings, the interior height of the tumbler block 20 is designed to be slightly less than the depth of the block restrictor relief 35 formed in the lock core 25. This provides the lock core 25 with the rotational stop points as generally shown by both FIGS. 4 and 5 of the drawings in order to ensure that the rotational movement of the lock core 25 does not exceed a 90° arc.

As is further illustrated in FIGS. 4 and 5 of the drawings, the tumblers 27 and 29 have a standard construction, including a tumbler arm 38 which is spring loaded relative to the lock core 25 by means of a coil spring 39.

In accordance with the present invention, therefore, it will be observed that the lock core 25 has been adapted by providing the same with a block restrictor relief portion 35, which cooperates with the tumbler block 20 positioned within the interior confines of the cylindrical housing 12 in order to accommodate the 90° rotational movement of the lock core 25 therein. Furthermore, by having the tumbler block 20 extend inwardly into the interior confines of the cylindrical housing 12 for a distance beyond the tumbler ledge 22, the cooperative action between the lock core 25 and the cylindrical housing 12 is accommodated. This construction further permits all of the tumblers 27 and 29 respectively to be constructed identically thereby eliminating the need for a special release tumbler as is typically known in the prior art devices. This construction also has the effect of eliminating the need for any special grooving procedures to specially groove the cylindrical housing in order to accommodate the special release tumbler again, as is well known in the prior art.

The above construction further permits the cylindrical housing portion to be diecast as a single part, thereby eliminating the extra manufacturing steps of grooving and deburring as has heretofore been described. The elimination of the necessity for grooving the interior walls of the cylindrical housing and for eliminating special release tumblers has a significant cost saving to a manufacturer, and the elimination of these features is considered a significant improvement for cylindrical locks of the type intended to have a removable lock core positioned therein. It will also be appreciated that the relative dimensioning between the block restrictor relief 35 and the tumbler block 20 is again deemed important since the release tumbler 29, when manipulated into the release position, is designed to ride out of contact with the shoulder 23 of the tumbler ledge 22, and into the block restrictor relief portion 35 of the lock core 25. Hence, by increasing the circumferential length of the block restrictor relief portion 35 beyond the circumferential length of the tumbler block 20, this operational feature is achieved.

While there has been described what is considered to be the preferred embodiments of the invention, it will be understood that various modifications may be made therein, and it is intended to cover in the appended claims all such modifications as fall within the true spirit and scope of the invention.

I claim:

1. In a rotatable cylinder lock of the type formed by an elongated cylindrical housing including an outer end and an inner end, a removable lock core adapted for removable engagement within said cylindrical housing and carrying a plurality of lock tumblers and a release tumbler along the length thereof, the lock tumblers being actuated by a bitted key for effecting the rotation of the lock core between the locked and unlocked positions thereof respectively, and the release tumbler being actuated by a release key for effecting the release and removal of the lock core from the cylindrical housing when the lock core is in the unlocked position, the improvement comprising in combination:

the cylindrical housing provided with a tumbler block mounted therein and extending inwardly for a distance.

a tumbler ledge formed in said cylindrical housing and extending inwardly for a distance, and extending circumferentially around a portion of the interior periphery of said cylindrical housing.

said tumbler ledge forming a shoulder for providing a riding surface for the release tumbler to ride on as the care is rotated said lock core provided with a block restrictor relief section formed therein along the inner end thereof, said block restrictor relief section constructed and positioned to accommodate the positioning of said tumbler block therein when said lock core is fully positioned within said cylindrical housing, and the release tumbler positioned to be retractable into said block restrictor relief section when actuated into a release position by the release key, and into overriding relation with said shoulder formed by said tumbler ledge and in blocking relation with respect to said tumbler block to prevent removal of said lock core

2. The improved rotatable cylinder lock of the type set forth in claim 1 above, wherein said tumbler block extends inwardly into said cylindrical housing for a distance greater than the height of said tumbler ledge.

3. The improved rotatable cylinder lock as set forth in claim 1 above, wherein said block restrictor relief section formed in said lock core has a greater circumferential length than the circumferential length of said tumbler block.

4. The improved retatable cylinder lock as set forth in claim 3 above, wherein the circumferential length of said block restrictor relief section is sufficiently greater than the circumferential length of said tumbler block in order to allow the release tumbler to ride into said block restrictor relief section when actuated by the release key when the lock core is positioned in the unlocked position.

5. The improved rotatable cylinder lock as set forth in claim 3 above, wherein said tumbler block formed in said cylindrical housing cooperates with said block restrictor relief section to establish stop positions for the rotational movement of said lock core as said block restrictor relief section rotates.

6. The improved rotatable cylinder lock as set forth in claim 5 above, wherein said block restrictor relief section in combination with said tumbler block permits no more than a 90° arc of rotation of said lock core relative to said cylindrical housing thereby to establish a locked position and an unlocked position located 90° apart.

* * * * *